US006338791B1

(12) United States Patent
Ragil et al.

(10) Patent No.: US 6,338,791 B1
(45) Date of Patent: Jan. 15, 2002

(54) HIGH OCTANE NUMBER GASOLINES AND THEIR PRODUCTION USING A PROCESS ASSOCIATING HYDRO-ISOMERIZATION AND SEPARATION

(75) Inventors: Karine Ragil; Sophie Jullian, both of Rueil Malmaison; Jean-Pierre Durand, La Celle Saint Cloud; Gérard Hotier, Chaponost; Olivier Clause, Chatou, all of (FR)

(73) Assignee: Institut Francais du Petrole, Paris (FR)

( * ) Notice: Subject to any disclaimer, the term of this patent is extended or adjusted under 35 U.S.C. 154(b) by 0 days.

(21) Appl. No.: 09/517,071

(22) Filed: Mar. 1, 2000

Related U.S. Application Data

(62) Division of application No. 09/199,482, filed on Nov. 25, 1998, now abandoned.

(30) Foreign Application Priority Data

Nov. 25, 1997 (FR) ..... 97 14891

(51) Int. Cl.[7] ..... C10G 59/02; C10G 35/08

(52) U.S. Cl. ..... 208/63; 208/16; 208/133; 208/62; 208/92; 585/734; 585/738; 585/14

(58) Field of Search ..... 208/16, 133, 62–63, 208/92; 585/734, 738, 14

(56) References Cited

U.S. PATENT DOCUMENTS 4,146,462 A * 3/1979 Rustamov et al. ..... 208/46
5,107,059 A * 4/1992 Chen et al. ..... 585/818
5,146,037 A * 9/1992 Zarchy et al. ..... 585/738
5,233,120 A * 8/1993 Minkkinen et al. ..... 585/737
5,245,102 A * 9/1993 Zarchy et al. ..... 585/738
5,326,928 A * 7/1994 Benazzi et al. ..... 208/820
5,602,291 A * 2/1997 Minkkinen et al. ..... 585/738
5,811,630 A * 9/1998 Dandekar et al. ..... 585/738
5,831,140 A * 11/1998 Joly et al. ..... 585/736
5,994,607 A * 11/1999 Joly et al. ..... 585/736

* cited by examiner

*Primary Examiner*—Nadine Preisch
(74) *Attorney, Agent, or Firm*—Millen, White, Zelano & Branigan, P.C.

(57) ABSTRACT

The invention provides a high octane number gasoline pool comprises at least 2% of di-branched paraffins containing 7 carbon atoms, and a process for producing this gasoline pool by hydro-isomerizing a feed constituted by a C5 to C8 cut which comprises at least one hydro-isomerization section and at least one separation section, in which the hydro-isomerization section and at least one separation section, in which the hydro-isomerization section comprises at least one reactor. The separation section comprises at least one unit and produces at least two streams: a first stream which is rich in di- and tri-branched paraffins, and possibly in naphthenes and aromatic compounds which is sent to the gasoline pool; and in a first version of the process, a second stream is produced which is rich in straight-chain and mono-branched paraffins which is recycled to the inlet of the hydro-isomerization section, while in a second version of the process, a second flux is produced which is rich in straight-chain paraffins which is recycled to the inlet of a first hydro-isomerization section and a third stream is produced which is rich in mono-branched paraffins which is recycled to the inlet of a second hydroisomerization section.

3 Claims, 2 Drawing Sheets

FIG.2.1A

FIG.2.1B

Figure 1A:
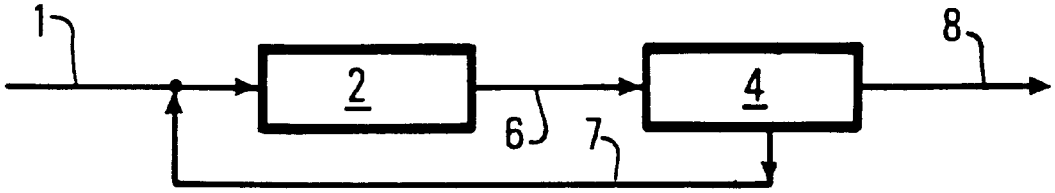

FIG.2.2A
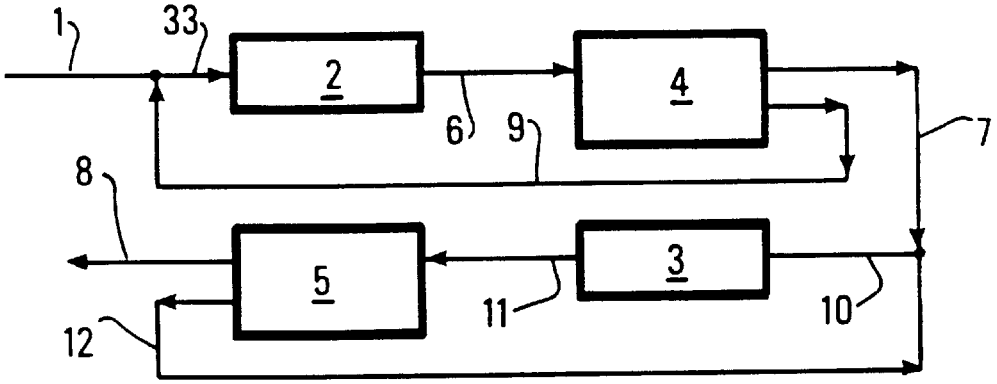
FIG.2.2B
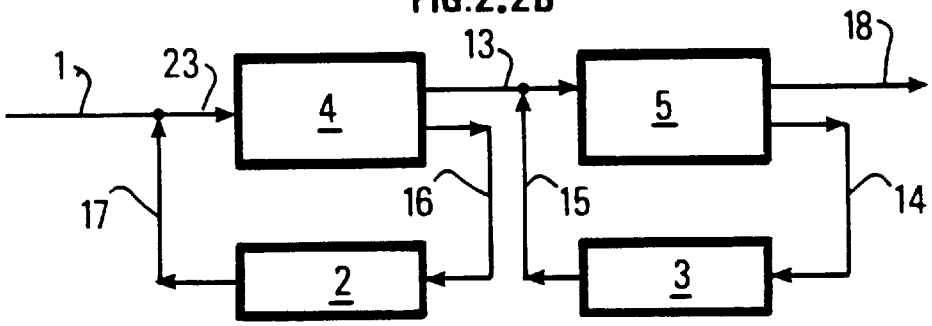
FIG.2.2C
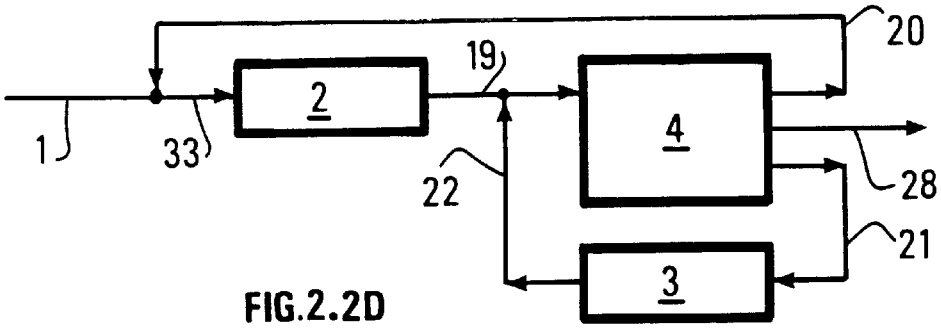
FIG.2.2D
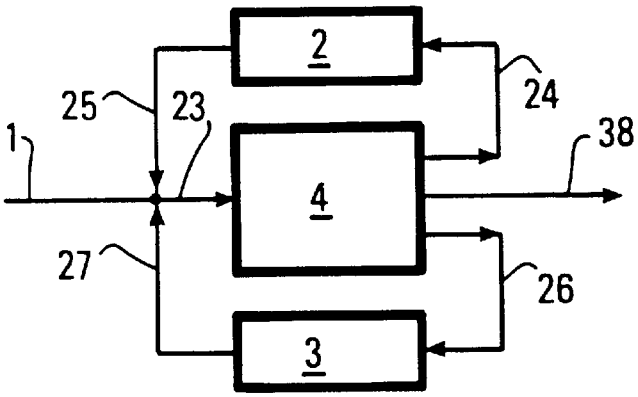

HIGH OCTANE NUMBER GASOLINES AND THEIR PRODUCTION USING A PROCESS ASSOCIATING HYDRO-ISOMERIZATION AND SEPARATION

This is a division of application Ser. No. 09/199,482 filed Nov. 25, 1998, now abandoned.

The invention relates to a process for producing a high octane number gasoline pool comprising at least 2% by weight, preferably at least 3% by weight, and more preferably at least 4.5% by weight, of C7 di-branched paraffins, i.e., di-branched paraffins containing 7 carbon atoms. As a preferred example, such a gasoline pool can be obtained by incorporating into said pool a gasoline stock from hydro-isomerisation of a feed constituted by a C5–C8 cut or any cut between C5 and C8, i.e., a cut comprising hydrocarbons containing 5 to 8 carbon atoms, such as C5–C8, C6–C8, C7–C8, C7, C8, etc . . . This invention is an improvement over conventional refining schemes as it proposes upgrading light C5 to C8 cuts comprising paraffinic, naphthenic, aromatic and olefinic hydrocarbons, by hydro-isomerisation and recycling of low octane number paraffins, i.e., straight-chain and mono-branched paraffins. Hydro-isomerisation of light C5 to C8 cuts can be carried out in the gas, liquid or mixed liquid-gas phase in one or more reactors where the catalyst is used in a fixed bed. Normal and mono-branched paraffins can be recycled in the liquid or gas phase using a separation process involving adsorption or permeation using respectively one or more adsorbents, or one or more permeation steps.

In one version of the process, the process comprises at least one hydro-isomerisation section and at least one separation section. The hydro-isomerisation section comprises at least one reactor. The separation section (composed of one or more units) produces two streams, a first stream rich in di- and tri-branched paraffins, and possibly in naphthenes and aromatic compounds, which constitutes a high octane number gasoline stock and which is sent to the gasoline pool, and a second stream which is rich in straight-chain and mono-branched paraffins and which is recycled to the inlet to the hydro-isomerisation section. When separating by adsorption, this version of the process, optimised for feeds containing more than 12 mole %, preferably more than 15 mole % of C7+ (i.e., hydrocarbons containing at least 7 carbon atoms) uses an adsorbable eluent to completely or at least partially regenerate the adsorbent.

In a second version of the process, the process comprises at least two hydro-isomerisation section and at least one separation section. The separation section (composed of one or more units) produces three streams: a first stream which is rich in di- and tri-branched paraffins, and possibly in naphthenes and aromatics which constitutes a high octane number gasoline stock and is sent to the gasoline pool, a second stream which is rich in straight-chain paraffins which is recycled to the inlet of the first hydro-isomerisation section, and a third stream which is rich in mono-branched paraffins which is recycled to the inlet of the second section. Two implementations of this version of the process are preferred: in the first, all of the effluent from the first hydro-isomerisation section traverses the second section, and in the second the effluents from the hydro-isomerisation sections are sent to the separation section or sections.

Carrying out the process enables:

- the amount of total aromatic compounds in a conventional gasoline pool to be reduced by 3% to 12% by weight, depending on the composition of the pool and in particular depending on the reformed gasoline fraction and the hydro-isomerisation gasoline introduced;

- the amount of benzene in the gasoline pool to be significantly reduced;
- the severity of the operation of the associated catalytic reforming units to be reduced.

PRIOR ART

Increasing environmental constraints have resulted in the removal of lead compounds from gasolines, effectively in the United States and Japan and becoming general in Europe. Aromatic compounds, the main constituents of reformed gasolines, and isoparaffins produced by aliphatic alkylation or isomerisation of light gasolines initially compensated for the octane number loss resulting from removing lead from gasoline. Subsequently, oxygen-containing compounds such as methyl tertiobutyl ether (MTBE) or ethyl tertiobutyl ether (ETBE) were introduced into the gasolines. More recently, the known toxicity of compounds such as aromatic compounds, in particular benzene, olefins and sulphur-containing compounds, as well as the desire to reduce the vapour pressure of the gasolines, led the United States to produce reformulated gasolines. As an example, the maximum amounts of olefins, aromatic compounds and benzene in gasoline distributed in California in 1996 were respectively 6% by volume, 25% by volume, and 1% by volume. Regulations are less severe in Europe, but nevertheless there is a clear tendency to reduce the maximum benzene, aromatic compound and olefin amounts in gasoline which is produced and sold to a similar level.

Gasoline pools contain a plurality of components. The major components are reformed gasoline, which normally comprises between 60% and 80% by volume of aromatic compounds, and FCC gasolines which typically contain 35% by volume of aromatic compounds but provide the majority of olefinic and sulphur-containing compounds present in the gasoline pools. The other components can be alkylates, with neither aromatic compounds nor olefinic compounds, light gasolines which may or may not be isomerised, which contain no unsaturated compounds, oxygen-containing compounds such as MTBE, and butanes. Provided that the aromatic compound content is not reduced below 35–40% by volume, the contribution of reformates to gasoline pools remains high, typically 40% by volume. In contrast, increased severity as regards the maximum admissible amount of aromatic compounds to 20–25% by volume will result in a reduction in the use of reforming, and as a result the need to upgrade C7–C10 straight run cuts by routes other than reforming.

Thus the production of multi-branched isomers from low-branched heptanes and octanes contained in naphthas, instead of producing toluene and xylenes from those compounds, appears to be an extremely promising route. This justifies the search for high performance catalytic systems for isomerising heptanes (also termed hydro-isomerisation when carried out in the presence of hydrogen), octanes and more generally C5–C8 cuts and intermediate cuts, and the search for processes for selectively recycling low octane number compounds which are straight-chain and mono-branched paraffins to the isomerisation (hydro-isomerisation) step. Regarding the catalytic systems, a compromise has to be found between isomerisation proper and acid cracking or hydrogenolysis, which produces light C1–C4 hydrocarbons which drop the overall yields. Thus the more branched the paraffin, the more easily it isomerises but also the greater is its tendency to crack. This justifies the search for more selective catalysts, and for processes which are arranged to supply different hydro-isomerisation sections with streams which are rich in straight-chain or mono-branched paraffins. The catalytic systems described in the literature use bifunctional catalysts such as Pt/zeolite b (Martens et al., J. Catal., 1995, 159, 323), Pt/SAPO-5 or Pt/SAPO-11 (Campelo et al., J. Chem. Soc., Faraday Trans., 1995, 91, 1551), massive or SiC supported mono-functional oxycarbide catalysts (Ledoux et al., Ind. Eng. Chem. Res., 1994, 33, 1957), mono-functional acid systems such as chlorinated aluminas (Travers et al, Rev. Inst. Fr. Petr., 1991, 46, 89), sulphated zirconias (Iglesia et al., J. Catal., 1993, 144, 238) or some heteropolyacids (Vedrine et al., Catal. Lett., 1995, 34, 223).

Adsorption and permeation separation techniques are particularly suitable for separating straight-chain, mono- and multi-branched paraffins. Processes for separation by conventional adsorption can be based on PSA (pressure swing adsorption), TSA (temperature swing adsorption), chromatography (elution chromatography or simulated counter-current chromatography, for example). They can also result from a combination of the above. Such processes all involve bringing a liquid or gaseous mixture into contact with a fixed bed of adsorbent to eliminate certain constituents of the mixture which may be adsorbed. Desorption can be carried out by various means. Thus the common characteristic of PSA is to regenerate the bed by depressurisation and in certain cases by low pressure flushing. PSA type processes are described in U.S. Pat. No. 3,430,418 by Wagner or in the more general work by Yang ("Gas Separation by Adsorption Processes", Butterworths, US, 1987). In general, PSA type processes are operated sequentially using all of the adsorption beds in alternation. Such PSA techniques have been very successful in the natural gas industry, for separating compounds of air, for producing solvents, and in various refining sectors.

TSA processes use temperature as the driving force for desorption and were the first to have been developed for adsorption. The bed to be regenerated is heated by circulating a pre-heated gas, in a closed or an open loop, in a direction which is the reverse of that of adsorption. A number of variations ("Gas Separation by Adsorption Processes", Butterworths, US, 1987) are used depending on local constraints and on the nature of the gas employed. The technique is generally used in purification processes (drying, desulphuration of gas and liquids, purification of natural gas: U.S. Pat. No. 4,770,676).

Liquid or gas phase chromatography is a highly effective separation technique because a very large number of theoretical plates is used (BE 891 522, Seko M., Miyake J., Inada K.: Ind. Eng. Chem. Prod. Res. Develop., 1979, 18, 263). It can thus exploit relatively low adsorption selectivities and accomplish difficult separations. Such processes are competed with by simulated moving bed or simulated counter current continuous processes. The latter have been greatly developed in the petroleum industry (U.S. Pat. Nos. 3,636,121 and 3,997,620). Regeneration of the adsorbent uses the technique of displacement by a desorbent which can optionally be capable of being separated by distilling the extract and the raffinate.

The use of adsorption processes in the gasoline production area is well known and a number of patents refer to it, based on geometrical (U.S. Pat. No. 5,233,120, BE 891 522, FR-A-2 688 213) and diffusional (U.S. Pat. Nos. 5,055,633 and 5,055,634) selectivities. Such processes, however, all pertain to the light C5–C6 fraction with the aim of improving the octane number. U.S. Pat. Nos. 5,055,633 and 5,055,634 concern processes for separating and producing isopentane with a stream which is rich in di-branched paraffins from a light C5–C6 cut containing at least 10% of isopentane. C5–C6 centred cuts can sometimes contain small quantities of paraffins containing seven or more carbon atoms. However, the processes claimed in those patents all pertain to less than 10 mole % of such C7+ compounds.

The advantage of permeation separation techniques over adsorption techniques is that they are continuous and, as a result, relatively simple to carry out. Further, they are recognised for their modularity and compactness. Over the past ten years they have taken their place beside adsorption and gas separation techniques, for example for recovering hydrogen from refining gas, decarbonating natural gas, producing inerting nitrogen ("Handbook of Industrial Membranes", Elsevier Science Publishers, UK, 1995). Their use in separating isomeric hydrocarbons is rendered possible because of the recent advances in techniques for synthesising materials and more particularly in the inorganic material synthesis field where zeolite crystals can now be grown in the form of a thin continuous supported or self supported layer. International patent application WO 96/01687 describes a method for synthesising a supported zeolite membrane and its applications, in particular separating a mixture of normal and iso pentane. A further method for synthesising a supported zeolite membrane adapted for separating straight-chain alkanes from a mixture of more branched hydrocarbons is described in International patent WO 93/19840.

The permeabilities of straight-chain and branched hydrocarbons have been reported in the literature for films of self supported zeolite or zeolite deposited on supports of different natures.

As an example, Tsikoyiannis, J. G. and Haag, W. O., in Zeolite 1992, 12, 126–30, observed a permeability ratio of 17.2 for normal C6 (nC6) with respect to isoC6 (iC6) on a self supported ZSM-5 film.

Permeability measurements in pure gases on a membrane composed of silicalite crystals on a porous steel support have shown that the nC4 stream is larger than the iC4 stream (Geus, E. R.; Van Bekkum, H.; Bakker, W. J. W.; Moulijn, J. A. Microporous Mater. 1993, 1, 131–47). For these same cases the ratio of permeabilities (nC4/iC4) is 18 at 30° C. and 31 at 185° C. with a membrane constituted by ZSM-5 zeolite on a porous alumina support. Regarding the separation of nC6/2,2-dimethylbutane, a selectivity of 122 was measured with a silicalite membrane on a porous glass support (Meriaudeau P.; Thangaraj A.; Naccache C; Microporous Mater, 1995, 4, 213–19).

SUMMARY OF THE INVENTION

The invention provides a high octane number gasoline pool in which the total content of di-branched C7 paraffin content is at least 2% by weight, preferably at least 3% by weight, more preferably at least 4.5% by weight. Such di-branched C7 paraffins are, for example, represented by 2,2; 2,3; 2,4; and 3,3-dimethylpentane. These dimethylpentanes are collectively known as DMC5. A detailed study of the composition of commercial gasolines containing up to 30% of alkylate has demonstrated that the di-branched C7 paraffin content in such gasolines never exceeds 1.75% by weight.

It is possible to obtain a gasoline pool of the invention by incorporating into said pool a high octane number gasoline stock from hydro-isomerisation of C5 to C8 cuts such as C5–C8, C6–C8, C7–C8, C7, C8, etc . . .

In a further aspect, the invention provides processes for producing such a gasoline stock and thus such a pool. The processes of the invention are aimed at modifying the landscape of gasoline production by reducing the aromatic compound content while keeping the octane number high. This can be accomplished by sending a feed constituted by a C5–C8 cut (for example straight run) or any intermediate cut between C5 and C8, such as C5–C8, C6–C8, C7–C8, C7, C8, etc . . . , not to the reforming and C5–C6 paraffin hydro-isomerisation units but to at least one hydro-isomerisation section which converts the straight-chain paraffins (nCx, x=5 to 8) to branched paraffins and possibly mono-branched paraffins (monoCx) to di- and tri-branched paraffins (diCx or triCx).

It is appropriate at this juncture to summarise the research octane numbers (RON) and the motor octane numbers (MON) of different hydrocarbon compounds (see Table I).

TABLE 1

| Paraffin | nC8 | nC7 | monoC7 | monoC6 | diC6 | diC5 | triC4 | triC5 |
|---|---|---|---|---|---|---|---|---|
| RON | <0 | 0 | 21–27 | 42–52 | 55–76 | 80–93 | 112 | 100–109 |
| MON | <0 | 0 | 23–39 | 23–39 | 56–82 | 84–95 | 101 | 96–100 |

As Table 1 shows, conversion of the different paraffins of this cut must be as efficient as possible towards highly branched compounds. Since the hydro-isomerisation reaction is thermodynamically limited, it is necessary to separate and recycle to the hydro-isomerisation section in order to obtain a conversion which is as efficient as possible.

More precisely, the invention provides a process for producing a high octane number gasoline stock which can form part of the composition of a gasoline pool comprising at least 2% by weight, preferably at least 3% by weight, and more preferably at least 4.5% by weight, of di-branched C7 paraffins such as dimethylpentanes (DMC5) and a small amount of aromatic compounds by associating at least one hydro-isomerisation section comprising at least one hydro-isomerisation section and at least one second section accomplishing separation by adsorption or by permeation, in one or more units, recycling the straight chain and mono-branched paraffins to said hydro-isomerisation section. This association has other characteristics which will be detailed in the remainder of the text.

For all versions of the process of the invention, the normal and mono-branched paraffins are recycled in the liquid or gas phase using adsorption or permeation separation processes. The adsorption separation processes used may be PSA (pressure swing adsorption), TSA (temperature swing adsorption), chromatography (elution chromatography or simulated counter current chromatography, for example) or it can be a combination of these methods. The separation section can use one or more molecular sieves. When separation is accomplished by permeation, the isomerate (i.e., the effluent from the hydro-isomerisation section) can be separated using a gas permeation or pervaporation technique. In all versions of the process of the invention, the separation section(s) can be located upstream or downstream of the hydro-isomerisation section(s). when the feed to the process includes a C5 cut, the straight-chain and mono-branched paraffin recycling process can include at least one deisopentaniser and/or at least one depentaniser located upstream or downstream of the hydro-isomerisation sections and/or separation sections. The isopentane is preferably eliminated since it is not isomerised to a more branched compound under the operating conditions for the hydro-isomerisation section. Isopentane, pentane or a mixture of these two as separated can act as an eluent or the flushing gas for the adsorption or permeation separation processes respectively. When the cuts contain no C5 but contain C6 compounds, the process can comprise at least one deisohexaniser upstream or downstream of the hydro-isomerisation and separation sections. In general, it may be important to prepare one or more light fractions by distilling the feed, to act as an eluent or flushing gas for the adsorption or permeation separation processes respectively.

A preferred version of the process of the invention comprises a hydro-isomerisation section and a separation section. The hydro-isomerisation section comprises at least one reactor. The separation section produces two streams: a first stream which is rich in di- and tri-branched paraffins, and possibly in naphthenes and aromatic compounds which constitute a high octane number gasoline stock and which is sent to the gasoline pool; and a second stream which is rich in straight-chain and mono-branched paraffins which is recycled to the hydro-isomerisation section inlet. This version of the process, optimised for feeds containing more than 12 mole %, preferably more than 15 mole %, of C7+, uses (for adsorption separation) an adsorbable eluent to completely regenerate or at least partially regenerate the adsorbent. This eluent can be isopentane, n-pentane or isohexane previously extracted from the feed.

In a second preferred version of the process of the invention, the hydro-isomerisation reaction is carried out in at least two distinct sections. A process for separating into three streams is carried out in at least one section comprising one or more units to produce three effluents, respectively rich in straight-chain paraffins, in mono-branched paraffins and in di- and tri-branched paraffins, and possibly in naphthenes and aromatic compounds. The effluents which are rich in straight-chain and mono-branched paraffins are separately recycled, to one and to the other of the hydro-isomerisation sections or to two sections and/or two reactors which are different if there are more than two. The effluent which is rich in di- and tri-branched paraffins, and possibly in naphthenes and aromatic compounds, which constitutes a high octane number gasoline stock, is sent to the gasoline pool. The advantages of such a configuration are many-fold. It enables at least two reactors to be operated at different temperatures and different HSVs to minimise cracking of di- and tri-branched paraffins, which is particularly important for the cuts under consideration.

In a first implementation of this second version of the process, all of the effluent leaving the first hydro-isomerisation section is sent to the second hydro-isomerisation section. In a second implementation, the effluents from the hydro-isomerisation sections are sent to the separation section or sections. The process is thus optimised by the arrangement of the separation and hydro-isomerisation sections, since it can avoid mixing the high octane number streams with the low octane number feed.

DETAILED DESCRIPTION OF THE INVENTION

With regard to reducing the amount of aromatic compounds in gasolines, the feed treated in the process of the invention originates from a C5–C8 cut or any intermediate cuts (such as C5–C7, C6–C8, C6–C7, C7–C8, C7, C8 . . . ) from atmospheric distillation, from a reforming unit (light reformate) or from a conversion unit (naphtha hydrocracking, for example). In the remainder of the text, this set of possible feeds will be designated by the term "C5–C8 cuts and intermediate cuts".

It is mainly composed of straight-chain, mono-branched and multi-branched paraffins, naphthenic compounds such as dimethylcyclopentanes, aromatic compounds such as benzene or toluene and possibly olefinic compounds. The term "multi-branched paraffins" includes all paraffins with a degree of branching of two or more.

The feed introduced into the process of the invention comprises at least one alkane which will be isomerised to form at least one product with a higher degree of branching. The feed can contain normal pentane, 2-methylbutane, neopentane, normal hexane, 2-methylpentane, 3-methylpentane, 2,2-dimethylbutane, 2,3-dimethylbutane, normal heptane, 2-methylhexane, 3-methylhexane, 2,2-dimethylpentane, 3,3-dimethylpentane, 2,3-dimethylpentane, 2,4-dimethylpentane, 2,2,3-trimethylbutane, normal octane, 2-methylheptane, 3-methylheptane, 4-methylheptane, 2,2-dimethylhexane, 3,3-dimethylhexane, 2,3-dimethylhexane, 3,4-dimethylhexane, 2,4-dimethylhexane, 2,5-dimethylhexane, 2,2,3-trimethylpentane, 2,3,3-trimethylpentane, and 2,3,4-trimethylpentane. When the feed originates from C5–C8 cuts and/or intermediate cuts obtained after atmospheric distillation, it can also contain cyclic alkanes such as dimethylcyclopentanes, aromatic hydrocarbons (such as benzene, toluene, xylenes) and other C9+ hydrocarbons (i.e., hydrocarbons containing at least 9 carbon atoms) in small quantities. The feeds constituted by C5–C8 cuts and intermediate cuts from reformates can also contain olefinic hydrocarbons, in particular when the reforming units are operated at low pressure.

The amount of paraffins (P) essentially depends on the origin of the feed, i.e., on its paraffinic or naphthenic and aromatic character, sometimes measured using the parameter N+A (the sum of the amount of naphthenes (N) and the amount of aromatic compounds (A)), also its initial point, i.e., the amount of C5 and C6 in the feed. In hydrocracking naphthas, which are rich in naphthenic compounds, or light reformates, which are rich in aromatic compounds, the amount of paraffins in the feed will generally be low, of the order of 30% by weight. In straight run C5–C8 cuts and intermediate cuts (such as C5–C7, C6–C8, C6–C7, C7–C8 . . . ), the amount of paraffins varies between 30% and 80% by weight, with an average value of 55–60% by weight. The octane gain using the hydro-isomerisation process described in this patent will be higher as the amount of paraffins in the feed is increased.

For a C5–C8 feed or a feed composed of intermediate cuts from atmospheric distillation, obtained from the head of a naphtha splitter, for example, the heavy fraction corresponding to the naphtha can supply a catalytic reforming section. In this case, installation of a hydro-isomerisation section for these cuts will reduce the amount of feed in the reforming section, which could continue to treat the heavy C8+ naphtha fraction.

The hydro-isomerisation effluent can contain the same types of hydrocarbons as those described above, but their respective proportions in the mixture leads to higher RON and MON octane numbers than those of the feed.

The feed which is rich in paraffins containing 5 to 8 carbon atoms generally has a low octane number and the process of the invention has the advantage of increasing its octane number without increasing the aromatic compound content. In order to carry this out, a minimum of two sections should be used: the hydro-isomerisation section and the separation section. Several versions and implementations of the process are possible depending on the number and arrangement of the different hydro-isomerisation or separation sections and the different recycles.

For all versions and implementations of the process of the invention, the normal and mono-branched paraffins are recycled in the liquid or gas phase using adsorption or permeation separation processes. The adsorption separation processes used can be PSA (pressure swing adsorption), TSA (temperature swing adsorption), chromatography (elution chromatography or simulated counter current chromatography, for example) or it can be a combination of these methods. The separation section can use one or more molecular sieves. When separation is accomplished by permeation, a gas permeation or pervaporation technique can be used. In all versions of the process of the invention, the separation sections can be located upstream or downstream of the hydro-isomerisation section.

In a first preferred version of the process (FIGS. 1A and 1B for variations 1*a* and 1*b*), the hydro-isomerisation section (2) comprises at least one reactor. The separation section (4), constituted by at least one unit, produces two streams: a first high octane number stream which is rich in di- and tri-branched paraffins, and possibly in naphthenes and aromatic compounds (stream 8 for variation 1*a* and 18 for variation 1*b*), which constitutes a high octane number gasoline stock and can be sent to the gasoline pool; and a second stream which is rich in straight-chain and mono-branched paraffins which is recycled (7 for variation 1*a* and 9 for variation 1*b*), to the inlet to hydro-isomerisation section (2). In variation 1*a,* the hydro-isomerisation section 2 precedes separation section 4, while this is reversed in variation 1*b*. As a result in variation 1*a,* only straight-chain and mono-branched paraffins are recycled to the hydro-isomerisation section (stream 7). In variation 1*b,* all of effluent 10 from the hydro-isomerisation section 2 is recycled to separation section 4. The effluent thus contains straight-chain, mono-branched and multi-branched paraffins. The operating conditions for this variation of the p, described below, are selected with the aim of optimising the process for feeds containing more than 12 mole %, preferably more than 15 mole %, of C7+. They are particularly selected to minimise cracking of di and tri-branched paraffins containing more than 7 carbon atoms. Further, when the feed for the process includes a C5 cut, the straight-chain and mono-branched paraffin recycling process can optionally include a deisopentaniser, located upstream or downstream of the hydro-isomerisation and/or separation sections. In particular, it can be placed in feed 1 between the separation and hydro-isomerisation sections (streams 6 and 9) or in the recycled streams 7 and 10. The isopentane is preferably eliminated since it is not isomerised to a more branched compound under the operating conditions of the hydro-isomerisation section.

It may also be interesting to add a depentaniser or to combine a depentaniser and a deisopentaniser in at least one of streams 1, 6, 9, 7 or 10. The ispoentane, pentane or a mixture of these two extracted from the feed can optionally act as an eluent or flushing gas for the adsorption or permeation separation processes respectively. The isopentane can also optionally be sent directly to the gasoline pool due to its good octane number.

Figure 1B:
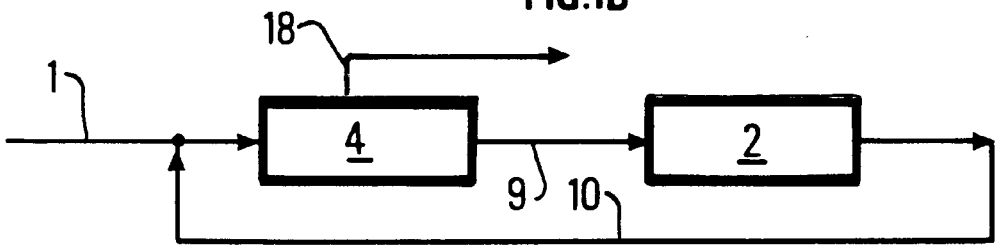
Figure 1B:
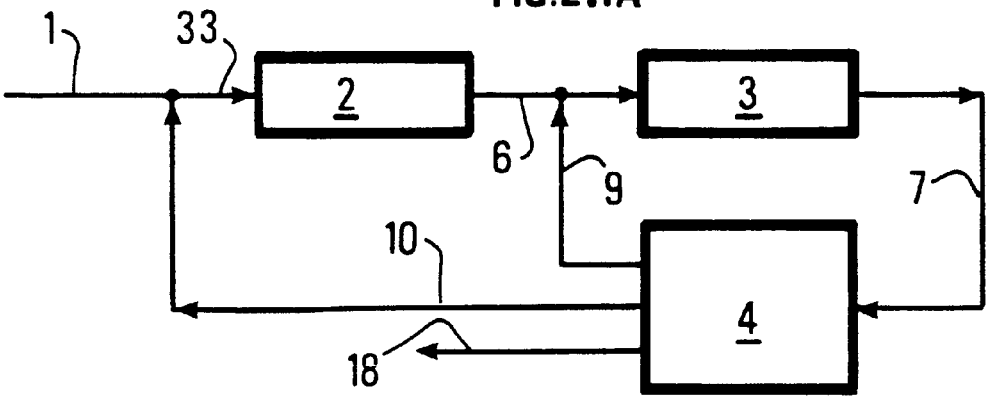
Figure 1B:
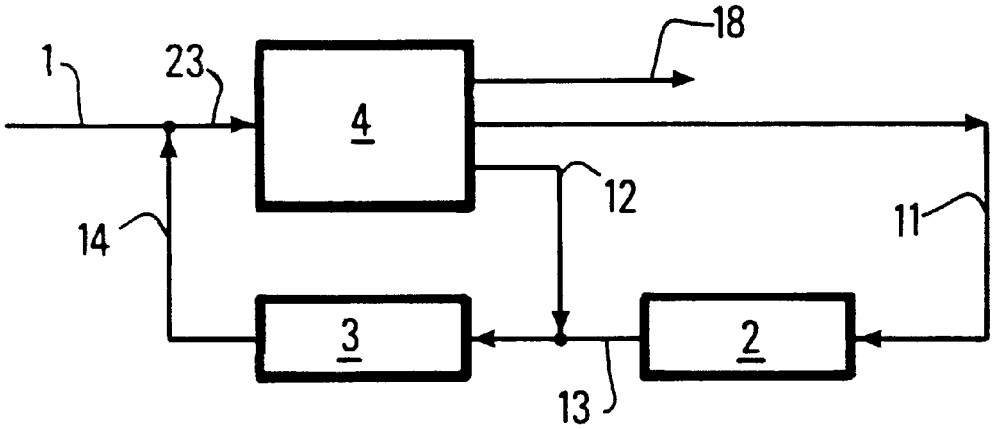

In the same manner, when the cut contains no C5 but contains C6 compounds, a deisohexaniser can optionally be placed in at least one of streams 1, 6, 7, 9 or 10 (FIGS. 1A and 1B). The recovered isohexane can act as an eluent or a flushing gas for the adsorption and permeation separation processes respectively. The isohexane is preferably not sent to the gasoline pool as its octane number is too low and it must thus be separated from high octane number streams 8 or 18 (FIGS. 1A and 1B). This use of a portion of the feed in the separation section constitutes very good integration for the process.

In general, it may be of interest to distil the feed into one or more light fractions which can act as an eluent or flushing gas for the adsorption or permeation separation processes respectively. However, this section can also use other compounds. In particular, light paraffins such as butane and isobutane can advantageously be used, as they are readily separated from heavier paraffins by distilling.

Finally, when the separation section is located upstream of the hydro-isomerisation section (variation 1*b*), the quantity of naphthenic and aromatic compounds traversing the hydro-isomerisation section is lower than in the reverse configuration (variation 1*a*). This limits saturation of the aromatic compounds contained in the C5 to C8 cut and thus reduces the hydrogen consumption in the hydro-isomerisation section. Further, in variation 1*b,* the volumes of the streams traversing the hydro-isomerisation section are lower with respect to variation 1*a,* enabling the size of this section to be reduced, minimising the quantity of catalyst required.

In a second preferred version of the process (FIGS. 2.1A, 2.1B, 2.2A, 2.2B, 2.2C, 2.2D respectively for variations 2.1*a* and *b;* 2.2*a, b, c* and *d* in implementations 2.1 and 2.2), the hydro-isomerisation reaction is carried out in at least two distinct sections, comprising at least one reactor (sections 2 and 3). A process for separation into at least three streams is carried out in at least one separation section (sections 4 and possibly 5), comprising at least one unit, to produce three streams: a first stream which is rich in di and tri-branched paraffins, and possibly in naphthenes and aromatic compounds; a second stream which is rich in straight-chain paraffins; and a third stream which is rich in mono-branched paraffins. The effluent which is rich in straight-chain paraffins is recycled to the hydro-isomerisation section 2 and the effluent which is rich in mono-branched paraffins is recycled to the hydro-isomerisation section 3.

In a first implementation (FIGS. 2.1A and 2.1B) of the second version of the process, all of the effluent leaving the first hydro-isomerisation section 2 is sent to the second hydro-isomerisation section 3. This implementation includes two variations in which the separation section, composed of one or optionally more units, is located downstream (FIG. 2.1A) or upstream (FIG. 2.1B) of the hydro-isomerisation section.

In variation 2.1*a* (FIG. 2.1A), fresh feed (stream 1) containing straight-chain, mono-branched and multi-branched paraffins, also naphthenic compounds and aromatic compounds, is mixed with a recycle of straight-chain paraffins from the separation section 4 (stream 10). The resulting mixture 33 is sent to the first hydro-isomerisation section 2 which converts a portion of the straight-chain paraffins to mono-branched paraffins and a portion of the mono-branched paraffins to multi-branched paraffins. The effluent (stream 6) leaving hydro-isomerisation section 2 is mixed with the recycle 9, which is rich in mono-branched paraffins and originates from separation section 4, then the mixture is sent to the hydro-isomerisation section 3. The effluent 7 from section 3 is sent to separation section 4. In section 4, a process for separation into three streams is carried out to produce three effluents which are rich in either straight-chain paraffins (10), mono-branched paraffins (9) or multi-branched paraffins, naphthenic compounds and aromatic compounds (8). Effluent 8 (FIG. 2.1A), which is rich in multi-branched paraffins and in naphthenic and aromatic compounds, has a high octane number, and constitutes a high octane number gasoline stock and can be sent to the gasoline pool. This process leads to the production of a high octane number gasoline which is rich in multi-branched paraffins.

In variation 2.1*b* (FIG. 2.1B), fresh feed (stream 1) containing straight-chain, mono-branched and multi-branched paraffins, naphthenes and aromatic compounds, is mixed with stream 14 from hydro-isomerisation section 3, then the resulting mixture 23 is sent to separation section 4. A process for separating into three streams is carried out to produce three effluents which are rich in either straight-chain paraffins (11), in mono-branched paraffins (12), or in multi-branched paraffins, naphthenic and aromatic compounds (18). The effluent 11 which is rich in straight-chain paraffins is sent to the hydro-isomerisation section 2. The effluent 18 which is rich in multi-branched paraffins and in naphthenic and aromatic compounds has a high octane number. Effluent 18 (FIG. 2.1B) thus constitutes a high octane number gasoline stock and can be sent to the gasoline pool. Hydro-isomerisation section 2 converts a portion of the straight-chain paraffins to mono-branched paraffins and to multi-branched paraffins. The stream which is rich in mono-branched paraffins (12) from separation section 4 is added to the effluent (13) from section 2. This is sent to the second hydro-isomerisation section 3 (FIG. 2.1B).

The advantages of the configurations of variations 2.1*a* and 2.1*b* are many-fold. These configurations enable two hydro-isomerisation sections 2 and 3 to be operated at different temperatures and different HSVs so as to minimise cracking of di-branched and tri-branched paraffins, which is particularly important for the cuts under consideration. Further, they enable the quantity of catalyst in section 2 to be minimised by recycling only straight-chain paraffins to this section, enabling a higher temperature to be used. In contrast, section 3, mainly supplied with mono-branched paraffins, operates at a lower temperature which improves the yield of di and tri-branched paraffins because of the more favourable thermodynamic equilibrium under these conditions, while limiting cracking of multi-branched paraffins, not encouraged at low temperatures.

When the separation section, composed of one or more units, is located upstream of the hydro-isomerisation section (variation 2.1*b*), the quantity of naphthenic and aromatic compounds traversing the hydro-isomerisation section is lower than in the reverse configuration (variation 2.1*a*). This limits saturation of the aromatic compounds contained in the C5–C8 cut or in the intermediate cuts, thus reducing the hydrogen consumption in the process.

When the feed includes a C5 cut, the process of the invention in its implementation 2.1 (variations 2.1*a* and 2.1*b*) can optionally comprise a deisopentaniser located upstream or downstream of the hydro-isomerisation and/or separation sections. In particular, the deisopentaniser can be placed in stream 1 (feed), between the two hydro-isomerisation sections (stream 6 FIG. 2.1A and stream 13 FIG. 2.1B), or after the hydro-isomerisation section (stream 7 or 14), after the separation section in the mono-branched paraffin rich stream (stream 9 or 12). Preferably, the isopentane can optionally be eliminated since it is not isomerised to a higher degree of branching under the operating conditions of the hydro-isomerisation section. The isopentane can optionally be used as an eluent or a flushing gas for the adsorption or permeation separation processes respectively. It can also optionally be sent directly to the gasoline pool because of its good octane number. It may be of interest to place a depentaniser in at least one of streams 1, 6, 7, 10 (FIG. 2.1A) or 1, 11, 13 or 14 (FIG. 2.1B). A combination of a deisopentaniser and a depentaniser is also possible. The pentane or mixture of pentane and isopentane thus separated can optionally be used as an eluent or a flushing gas for the adsorption or permeation separation processes respectively. In the latter case, the pentane cannot be sent to the gasoline pool because of its low octane number. As a result it has to be separated from high octane number streams 8 and 18.

In the same manner, when the cut contains no C5 but contains C6, a deisohexaniser can optionally be placed in at least one of streams 1, 6, 7 or 9 for variation 2.1*a* (FIG. 2.1A) and 1, 13, 14 and 12 for variation 2.1*b* (FIG. 2.1B). The recovered isohexane can act as an eluent or a flushing gas respectively for the adsorption and permeation separation processes. The isohexane cannot, however, be sent to the gasoline pool as its octane number is too low and it must thus be separated from high octane number streams 8 or 18 (FIGS. 2.1A and 2.1B).

In general, it may be of interest to prepare the feed by distillation into one or more light fractions, which can act as an eluent or a flushing gas for the adsorption or permeation separation processes respectively.

These uses for a portion of the feed in the separation section constitute very good integration for the process. However, this section can also use other compounds. In particular, light paraffins such as butane and isobutane are of interest as they can readily be separated from heavier paraffins by distilling.

In a second implementation (2.2) of version 2 of the process of the invention, the effluents from the hydro-isomerisation sections 2 and 3 are sent to one or more separation sections 4 and 5. This implementation can be split into four variations 2.2*a*, 2.2*b*, 2.2*c*, 2.2*d*. Variations 2.2*a* and 2.2*b* (FIGS. 2.2A and 2.2B) correspond to the case where the process comprises at least two separation sections which can carry out two different types of separation. In variations 2.2*c* and 2.2*d* (FIGS. 2.2C and 2.2D), the separation section can be constituted by one or more units. Variations 2.2*a*, 2.2*b*, 2.2*c* and 2.2*d* optimise the arrangement of separation and hydro-isomerisation sections as they prevent the high octane number streams from mixing with the low octane number feed.

Variation 2.2*a* comprises the following steps:

The fresh feed (stream 1, FIG. 2.2A) containing straight-chain, mono-branched and multi-branched paraffins, naphthenic compounds and aromatic compounds, is mixed with an effluent 9 which is rich in straight-chain paraffins from separation section 4, then the resulting mixture 33 is sent to hydro-isomerisation section 2 which converts a portion of the straight-chain paraffins to mono-branched paraffins and a portion of the mono-branched paraffins to multi-branched paraffins. The ensemble leaving hydro-isomerisation section 2 is sent to separation section 4. Separation section 4 produces two effluents which are respectively rich in straight-chain paraffins (9) and in mono-branched and multi-branched paraffins, naphthenic compounds and aromatic compounds (7). Effluent 7 is mixed with stream 12 which is rich in mono-branched paraffins from separation section 5, then sent to hydro-isomerisation section 3. The hydro-isomerisation section 3 converts a portion of the mono-branched paraffins to multi-branched paraffins. The ensemble (stream 11) leaving hydro-isomerisation section 3 is sent to separation section 5. In that section a process is carried out which separates it into two streams to produce two effluents, one rich in mono-branched paraffins (12) and the other rich in multi-branched paraffins (8). Effluent 8 (FIG. 2.2A), which is rich in di and tri-branched paraffins and in naphthenic and aromatic compounds, has a high octane number, and constitutes a high octane number gasoline stock and can be sent to the gasoline pool.

Variation 2.2*b* differs from variation 2.2*a* in that the separation sections 4 and 5 (FIG. 2.2B) are placed upstream of hydro-isomerisation sections 2 and 3. In this configuration, feed 1 is mixed with effluent 17 from hydro-isomerisation section 2, then the resulting mixture is sent to separation section 4. That section produces two streams, respectively rich in straight-chain paraffins (16) and in mono-branched and multi-branched paraffins (13).

Stream 16 is sent to the hydro-isomerisation section 2 to produce effluent 17. Effluent 13 is mixed with stream 15 from hydro-isomerisation section 3, then the mixture is sent to separation section 5. That section produces two effluents, one rich in mono-branched paraffins 14, which is sent to the hydro-isomerisation section 3, the other rich in multi-branched paraffins, naphthenic compounds and aromatic compounds 18, which has a high octane number and constitutes a high octane number gasoline stock. Effluent 18 (FIG. 2.2B) can thus be sent to the gasoline pool.

In variation 2.2*c* (FIG. 2.2C), the separation section 4 is constituted by one or more units, and is located between two hydro-isomerisation sections (2 and 3). In this configuration, feed 1 is mixed with the straight-chain paraffin rich effluent from separation section 4, and the resulting mixture 33 is sent to hydro-isomerisation section 2. This produces an effluent 19 with a higher octane number than that of the feed. This effluent 19 is mixed with effluent 22 from hydro-isomerisation section 3, then the ensemble is sent to separation section 4. This section produces three streams 20, 21 and 28. Stream 21, which is rich in mono-branched paraffins, is sent to hydro-isomerisation section 3 which converts these paraffins into higher branched paraffins. Stream 28, which is rich in multi-branched paraffins, naphthenic compounds and aromatic compounds, has a high octane number and constitutes a high octane number gasoline stock. Effluent 28 (FIG. 2.2C) can thus be sent to the gasoline pool.

In variation 2.2*d* (FIG. 2.2D), the separation section which is constituted by one or more units, is placed upstream of the two hydro-isomerisation sections. In this configuration, feed 1 is mixed with recycled streams 25 and 27 from hydro-isomerisation sections 2 and 3 respectively. The resulting stream 23 is sent to separation section 4. This produces three effluents 24, 26 and 38. Stream 24, to which is rich in straight-chain paraffins, is sent to hydro-isomerisation section 2 which converts these paraffins into higher branched paraffins. Stream 26, which is rich in mono-branched paraffins, is sent to the hydro-isomerisation section 3 which also converts these paraffins into branched paraffins. Stream 38, which is rich in multi-branched paraffins, aromatic compounds and naphthenic compounds, has a high octane number and constitutes a high octane number gasoline stock. Effluent 38 (FIG. 2.2D) can thus be sent to the gasoline pool.

The advantages of implementation 2.2 are many-fold. As for implementation 2.1, it enables the sections and/or the hydro-isomerisation reactor or reactors to be operated at different temperatures and different HSVs so as to minimise cracking of di and tri-branched paraffins. Further, it can minimise the quantity of catalyst by recycling only straight-chain paraffins to the hydro-isomerisation reactors 2 which enables a higher temperature to be used and thus minimises the quantity of catalyst in this section. The hydro-isomerisation reactor section 3, mainly supplied with mono-branched paraffins for variations 2.2*b, c* and *d* and with mono and multi-branched paraffins for variation 2.2*a,* operate at a lower temperature which improves the yield of di and tri-branched paraffins because of the more favourable thermodynamic equilibrium under these conditions, while limiting cracking of multi-branched paraffins, which is not favoured at low temperatures. This configuration (with the exception of variation 2.2*d*) can also avoid mixing high octane number streams with low octane number streams. Thus the recycling streams 9 (FIG. 2.2A) and 20 (FIG. 2.2C) which are rich in straight-chain paraffins are mixed with feed 1. Stream 12 which is rich in mono-branched paraffins is mixed with stream 7 which is rich in mono-branched and multi-branched paraffins. Finally, streams 15 and 22 from hydro-isomerisation sections 3 are respectively mixed with streams 13 and 19 with octane numbers which are higher than that of the feed.

In variations 2.2*b* and 2.2*d* (FIGS. 2.2B and 2.2D), the disposition of separation sections 4 and possibly 5 with respect to the hydro-isomerisation sections 2 and 3 is such that the quantity of naphthenic and aromatic compounds traversing the hydro-isomerisation section is lower than in variation 2.2*a*. This limits saturation of the aromatic compounds contained in the C5–C8 cut or in the intermediate cuts resulting in a lower hydrogen consumption for the process. Similarly, in variation 2.2*c,* the disposition of the separation section 4 with respect to the hydro-isomerisation section 3 enables the hydrogen consumption in the latter to be reduced.

As in the case of implementation 2.1, when the feed includes a C5 cut, the process of implementation 2.2 can optionally comprise a deisopentaniser located upstream or downstream of the separation and hydro-isomerisation sections. In particular, the deisopentaniser can be placed in feed stream 1, in any one of streams 1, 6, 7, 10, 11, 12 (FIG. 2.2A), in any one of streams 1, 13, 14, 15, 17 (FIG. 2.2B), in any one of streams 19, 21, 22 (FIG. 2.2C) and in any one of streams 23, 25 25, 26 or 27 (FIG. 2.2D). It may also be of interest to place a depentaniser in any one of streams 1, 6 or 9 (FIG. 2.2A) or 1, 16 or 17 (FIG. 2.2B), 1, 19 or 20 (FIG. 2.2C) or 1, 23, 24, or 25 (FIG. 2.2D). A combination of a deisopentaniser and a depentaniser is also possible. The isopentane, pentane or mixture of pentane and isopentane thus separated can optionally act as an eluent or a flushing gas for the adsorption or permeation separation processes respectively. In the latter case, the pentane is preferably not sent to the gasoline pool because of its low octane number. As a result, it is preferably separated from high octane number streams 8, 18, 28 and 38 (FIGS. 2.1A and 2.1B). In contrast, the isopentane is preferably sent to the gasoline pool with streams 8, 18, 28 and 38 because of its good octane number.

As for implementation 2.1, when the cut contains no C5 but contains C6, a deisohexaniser can optionally be placed on any one of streams 1, 6, 7, 10, 11 or 12 (FIG. 2.2A), or 1, 13, 14, 15 or 17 (FIG. 2.2B), 19, 21 or 22 for 2.2*c* and 23, 25, 26 or 27 (FIG. 2.2D). The isohexane recovered can act as an eluent or a flushing gas for the adsorption or permeation separation processes respectively. The isohexane is preferably not sent to the gasoline pool because of its low octane number. It is preferably separated from high octane number streams 8, 18, 28 and 38 (FIGS. 2.2A, 2.2B, 2.2C and 2.2D). This use of a portion of the feed in the separation section constitutes very good integration of the process. However, this section can also use other compounds as an eluent or a flushing gas for the adsorption or permeation separation processes respectively. In particular, light paraffins such as butane and isobutane are of interest as they can readily be separated from heavier paraffins by distillation.

For each of these variations and implementations, the hydro-isomerisation section is composed of at least one hydro-isomerisation section containing, for example, a catalyst from the family of bifunctional catalysts such as catalysts based on platinum or a sulphide phase on an acid support (chlorinated alumina, a zeolite such as mordenite, SAPO, Y zeolite, b zeolite) or from the family of mono-functional acid catalysts such as chlorinated aluminas, sulphated zirconias with or without platinum and promoter, heteropolyacids based on phosphorous and tungsten, molybdenum oxycarbides and oxynitrides which are normally ranked among the mono-functional catalysts with metallic character. They function in a range of temperatures between 25° C., for the most acidic (heteropolyanions, supported acids) and 450° C., for bi-functional catalysts or molybdenum oxycarbides. The chlorinated aluminas are preferably used between 80° C. and 110° C. and platinum based catalysts on a support containing zeolite are used between 260° C. and 350° C. The operating pressure is in the range 0.01 to 0.7 MPa, and depends on the C5–C6 concentration in the feed, the operating temperature and the H2/HC molar ratio. The space velocity, measured in kg of feed per kg of catalyst per hour, is in the range 0.5 to 2. The H2/hydrocarbons molar ratio is generally in the range 0.01 to 50, depending on the type of catalyst used and its resistance to coking at the operating temperatures. With low H2/HC ratios, for example H2/HC=0.06, it is not necessary to recycle the hydrogen, thus saving a separator drum and a hydrogen recycle compressor.

The hydro-isomerisation section can comprise one or more reactors disposed in series or in parallel which can, for example, contain one or more of the catalysts mentioned above. As an example, for variations 1*a* and 1*b* (FIGS. 1A and 1B), the hydro-isomerisation section 2 comprises at least one reactor, but can comprise two reactors or more disposed in series or in parallel. For variations 2.1*a* and *b* (FIGS. 2.1A and 2.1B), and 2.2*a, b, c* and *d* (FIGS. 2.2A, 2.2B, 2.2C, 2.2D), the hydro-isomerisation sections 2 and 3 can optionally comprise two reactors each, for example, optionally containing two different catalysts. Sections 2 and 3 can optionally also each comprise a plurality of reactors in series and/or in parallel, with different catalysts depending on the reactors.

Similarly, each separation section can be constituted by one or more units which can carry out overall separation into two or three effluents which are rich in straight-chain, mono and multi-branched paraffins, naphthenic compounds and aromatic compounds. Thus each of separation sections 4 and/or 5 of any one of variations 2.1*a* or *b,* 2.2*a, b, c* or *d,* comprise at least one separation unit which can be substituted by two or more separation units, disposed in series or in parallel.

When separating by adsorption, the section comprises at least one adsorption bed. This adsorber will, for example, be filled with a natural or synthetic adsorbent which can separate straight-chain, mono and multi-branched paraffins on the basis of geometrical, diffusional or thermodynamic differences.

A large number of adsorbent materials can carry out this type of separation. Among them are carbon, activated clay, silica gel, and activated alumina molecular sieves and crystalline molecular sieves. These latter have a uniform pore size and for this reason are particularly suitable for separation. Such molecular sieves include the different forms of silicoaluminophosphates and aluminophosphates described in U.S. Pat. Nos. 4,444,871, 4,310,440 and 4,567,027 as well as zeolitic molecular sieves. These, in their calcined form, can be represented by the chemical formula $M_{2/n}O:Al_2O_3:xSiO_2:yH_2O$ where M is a cation, x is in the range 2 to infinity, y is in the range 2 to 10 and n is the valency of the cation. For our purposes, microporous molecular sieves with an effective pore diameter of slightly more than 5 Å (1 Å=$10^{-10}$ m) are preferred. The term "effective pore diameter" is a conventional term in the art. It is used to functionally define the size of a pore in terms of the size of molecule which can enter the pore. It does not define the actual dimension of the pore as that is often difficult to determine since the pore is usually irregular in shape (i.e., non circular). D. W. Breck discusses the effective pore diameter in his book entitled "Zeolite Molecular Sieves", John Wiley and Sons, New York, 1974), pages 633 to 641.

Preferred microporous molecular sieves are those with elliptical pore cross sections with dimensions in the range 5.0 Å to 5.5 Å (5.0 to 5.5×$10^{-10}$ m) along the minor axis and about 5.5 to 6.0 Å along the major axis. An adsorbent with these characteristics, and thus particularly suitable for the present invention, is silicalite. The term "silicalite" includes here both silicopolymorphs described in U.S. Pat. No. 4,061,724 and F silicalite described in U.S. Pat. No. 4,073,865. Other adsorbents with the same characteristics and thus which are particularly suitable for our application are ZSM-5, ZSM-11, ZSM-48 and numerous other analogous crystalline aluminosilicates. ZSM-5 and ZSM-11 are described in U.S. Pat. No. 3,702,886, RE 29 948 and U.S. Pat. No. 3,709,979. The amount of silica in these adsorbents can vary. Adsorbents which are the most suitable for this type of separation are those with high silica contents. The Si/Al molar ratio should preferably be at least 10 and more preferably over 100.

A further type of adsorbent which is particularly suitable for our application contains elliptical cross section pores with dimensions in the range 4.5 Å to 5.5 Å. This type of adsorbent has been described in U.S. Pat. No. 4,717,748, for example, as being a tectosilicate with a pore size intermediate between that of pores of a calcium 5A sieve and the pores of ZSM-5. Preferred adsorbents from this family include ZSM-23 described in U.S. Pat. No. 4,076,872 and ferrierite described in U.S. Pat. Nos. 4,016,425 and 4,251,499.

The operating conditions for separation depend on its implementation and on the adsorbent under consideration. They are generally in the temperature range 50° C. to 450° C., and in the pressure range 0.01 MPa to 7 MPa. More precisely, if separation is carried out in the liquid phase, the separation conditions are generally: a temperature of 50° C. to 200° C. and a pressure of 0.1 MPa to 5 MPa. If said separation is carried out in the gas phase, these conditions are generally: a temperature of 150° C. to 450° C. and a pressure of 0.01 MPa to 7 MPa.

When the separation technique is permeation, the membrane used can be in the form of hollow fibres, bundles of tubes, or a stack of plates. Such configurations are known in the art and ensure homogeneous distribution of the fluid to be separated over all of the membrane surface, maintaining the pressure difference from one side to the other of the membrane, and recovering the fluid which has permeated separately from that which has not permeated. The selective layer can be formed from one of the adsorbent materials described above providing that it can form a uniform surface delimiting a section in which at least a portion of the feed can circulate, and a section in which at least a portion of the fluid which has permeated circulates.

The selective layer can be deposited on a permeable support which provides the mechanical strength of the membrane so constituted, as described in WO 96/01687 or WO 93/19840.

The selective layer is preferably formed by growing crystals of zeolite from a microporous support as described in European patents EP-A-0 778 075 and EP-A-0 778 076. In a preferred mode of the invention, the membrane is constituted by a continuous layer of silicalite crystals about 40 microns thick (1 micron=$10^{-6}$m), bonded to an alpha alumina support with a 200 nm pore size.

The operating conditions will be selected so as to maintain a chemical potential difference of the constituent(s) to be separated over the whole membrane surface to encourage their transfer through the membrane. The pressures either side of the membrane must allow average differences of transmembrane partial pressures of the constituents to be separated of 0.05 to 1 MPa.

To reduce the partial pressure of the constituents, it is possible to use a flushing gas or to maintain the vacuum using a vacuum pump at a pressure which, depending on the constituents, can be from 100 Pa to $10^4$ Pa and to condense vapours at very low temperatures, typically about −40° C. Depending on the hydrocarbons used, the temperatures should not exceed 200° C. to 400° C. to limit cracking and/or coking of olefinic and/or aromatic hydrocarbons in contact with the membrane. The rate of feed circulation is preferably such that it flows turbulently.

A pre-treatment consisting of desulphurisation and denitrogenation of the feed upstream of the hydro-isomerisation section is generally necessary. The effect of sulphur poisoning is particularly marked when bi-functional catalysts are used, as it results in an attenuation of the hydro-dehydrogenating function provided by the metal which means that the temperatures have to be increased to the detriment of the desired selectivity for C5–C8 compounds. Denitrogenation of the feed, particularly indispensable for converted naphthas, is essentially justified by neutralisation of the acid sites of the catalyst resulting from poisoning by nitrogen-containing bases. In certain particular cases, such as using sulphur- and nitrogen-depleted feeds (less than 100 ppm of sulphur-containing compounds, less than 0.5 ppm of nitrogen-containing compounds), and the use of thio and azoresistant catalysts such as molybdenum oxycarbides, pre-treatment of the feed is not indispensable. In other cases, in addition to desulphuration and denitrogenation, the feed must also be deoxygenated, consisting of eliminating traces of water, oxygen and oxygen-containing compounds such as ethers. This case is encountered, for example, when the catalyst is a chlorinated alumina, with or without platinum, used at low temperature (40–150° C.). Pre-treatment of the feed (stream 1) is generally carried out upstream of the hydro-isomerisation+separation section group. However, in the particular case of the sequence shown in FIG. 1*b*, pre-treatment can be carried out downstream of the separation section and selectively treat low octane number stream 9 intended to supply the hydro-isomerisation section. Similarly, in variations 2.1*b* and 2.2*b*, these pre-treatments can respectively be carried out on any one of streams 11 or 12 (FIG. 2.1B), 16 and 14 (FIG. 2.2B), or 24 and 26 (FIG. 2.2D).

Downstream of the hydro-isomerisation section, it is generally advantageous to provide a feed stabilisation column to limit the vapour tension of the isomerate to an acceptable value. The vapour tension is controlled by eliminating a certain quantity of volatile compounds, such as C1–C4, using techniques which are well known to the skilled person. In the absence of hydrogen recycling, hydrogen can be separated from the feed in the stabilisation column. When proper operation of one of the isomerisation catalysts used upstream requires the addition of a chlorinated agent upstream of the hydro-isomerisation section, the separation column can also eliminate the hydrogen chloride formed. In this case, it is advantageous to mount a washing drum for gases from the stabilisation step to limit discharge of acid gases to the atmosphere.

As described above, the separation section can be located upstream (FIGS. 1B, 2.1B, 2.2B, 2.2D) or downstream (FIGS. 1A, 2.1A, 2.2A, 2.2C) of the hydro-isomerisation section. In the first case, the major portion of the naphthenic and aromatic compounds avoid the hydro-isomerisation section, which has two important consequences:

the volume of the hydro-isomerisation section is smaller;

the aromatic compounds present in the feed are not saturated, resulting in a lower hydrogen consumption in the process and a smaller reduction in the octane number of the effluent.

In the second case (FIGS. 1A, 2.1A, 2.2A, 2.2C), the aromatic and naphthenic compounds traverse all or a part of the hydro-isomerisation section. It may thus be necessary to add a reactor for saturating the aromatic compounds, immediately upstream of the isomerisation section (if there is only one), or the first isomerisation section (if there is more than one). The criterion for adding a saturation reactor could, for example, be an aromatic compound content in the feed of over 5% by weight.

As illustrated in FIGS. 2.1A, 2.1B, 2.2A, 2.2B, 2.2C and 2.2D, there could also be at least two hydro-isomerisation sections 2 and 3 with recycling of a stream which is rich in straight-chain paraffins to the head of section 2 and recycling of a stream which is rich in mono-branched paraffins to the head of section 3. Such an arrangement enables the second section to be operated at a lower temperature than the first, which reduces cracking of the mono and multi-branched paraffins formed in the first section, in particular cracking of tri-branched paraffins such as 2,2,4 trimethylpentane which readily produces isobutane by acid cracking.

The following examples illustrate the importance of a process for hydro-isomerisation of C5–C8 cuts or intermediate cuts of the invention on the MON (motor octane number), the RON (research octane number), the total aromatic compound content and the benzene content for a variety of gasoline stocks with or without hydro-isomerisation gasoline.

In the examples, DMC5 represents the dimethylpentanes, i.e., the sum of the concentrations by weight of 2,2; 2,3; 2,4 and 3,3 dimethylpentanes, C7 di-branched paraffins.

EXAMPLE 1

Hydro-isomerisation of a Straight Run C7–C8 Cut

Consider the properties of a premium grade type gasoline pool constituted by a reformate, an FCC gasoline, an alkylate and an oxygen-containing compound (MTBE). Table 1 summarises the composition of the mixture by volume, the percentages by weight of paraffins, total aromatic compounds, benzene, olefins, dimethylC5 (DMC5), motor octane numbers and research octane numbers. The reformate, FCC gasoline and alkylate were effluents from existing units. The feed for the reforming unit was a straight run naphtha containing 0.18% by weight of benzene.

TABLE 1

| | Vol % | Paraf wt % | Aromat wt % | Benzene wt % | Olefins wt % | DMC5 wt % | RON | MON |
|---|---|---|---|---|---|---|---|---|
| Reformate | 50 | 25.1 | 73.0 | 3.2 | 0.8 | 1.3 | 98.7 | 88 |
| FCC | 30 | 24.7 | 34.6 | 1.2 | 33.1 | 1.2 | 94.8 | 83.4 |
| Alkylate | 10 | 99.9 | 0 | 0 | 0.1 | 3.3 | 93.4 | 91.9 |
| MTBE | 10 | 0 | 0 | 0 | 0 | 0 | 117 | 102 |
| Mixture | 100 | 30.0 | 46.9 | 2.0 | 10.3 | 1.3 | 98.8 | 86.3 |

By way of comparison, consider a premium grade type gasoline pool constituted by unchanged FCC gasoline, alkylate and MTBE bases, in the same proportions, with a smaller proportion of reformate, the complement being supplied by the effluent from a C7–C8 hydro-isomerisation process in accordance with the invention. to accomplish this, the C7–C11 feed from the reforming unit was separated by distillation into a C7–C8 hydro-isomerisation feed and a C9–C11 reforming feed. The composition of the reformate was estimated using tools which are known to the skilled person (correlative models, kinetic models, etc.). The composition of the isomerate was as that obtained after the pilot tests on the C7–C8 feed mentioned above. The hydro-isomerisation process was that represented in version 2, variation 2.1*b* of the invention (FIG. 2.1B). The separation section was placed upstream of the reaction section. The aromatic and naphthenic compounds initially contained in the feed were sent directly to the gasoline pool without isomerisation or saturation of the aromatic compounds.

TABLE 2

| | Vol % | Paraf wt % | Aromat wt % | Benzene wt % | Olefins wt % | DMC5 wt % | RON | MON |
|---|---|---|---|---|---|---|---|---|
| Reformate | 15 | 15.1 | 83.6 | 0.8 | 0.4 | 0 | 101.7 | 904 |
| FCC | 30 | 24.7 | 34.6 | 1.2 | 33.1 | 1.2 | 94.8 | 83.4 |
| C7–C8 | 35 | 53.3 | 12.2 | 0.4 | 0 | 13.9 | 82.7 | 81.0 |
| Hydro-isom alkylate | 10 | 99.9 | 0 | 0 | 0.1 | 3.3 | 93.4 | 91.9 |
| MTBE | 10 | 0 | 0 | 0 | 0 | 0 | 117 | 102 |
| Mixture | 100 | 32.3 | 27.2 | 0.5 | 10.1 | 5.6 | 95.6 | 86.2 |

Introducing the hydro-isomerisation effluent from the C7–C8 cut obtained using the process of the invention reduced the total aromatic compound content in the mixture by about 20% by weight. The benzene content reduced from 2% to 0.5%, the residual benzene coming from demethylation and deethylation of xylenes and A9+ aromatic compounds (i.e., aromatic compounds containing more than 9 carbon atoms) in the reforming step, also benzene present in the distillation naphtha since the separation section was located upstream of the hydro-isomerisation section. The research octane number showed a reduction of 3.2 points while the motor octane number remained unchanged. This latter point is one of the main advantages of the C7–C8 cut hydro-isomerisation process of the invention. The substantial reduction in aromatic compounds, in particular of benzene in the mixture was not accompanied by a reduction in the motor octane number.

The dimethylpentane content (DMC5 in the Table) increased substantially on introducing the C7–C8 hydro-isomerisation gasoline, from 1.3% to 5.6% by weight. In a "standard" gasoline pool containing no C7–C8 hydro-isomerisation gasoline stock, the major portion of the DMC5s originate from the alkylate. As a result, gasoline pools containing the most DMC5 are pools which are the richest in alkylates. However, an examination of the composition of commercial gasolines containing up to 30% of alkylate has shown that the DMC5 content in these gasolines never exceeded 1.75% by weight.

EXAMPLE 2

Hydro-isomerisation of a Straight Run C5–C8 Cut

Consider the properties of a premium grade type gasoline pool constituted by the following bases: a reformate, an FCC gasoline, an alkylate, an oxygen-containing compound and a C5–C6 hydro-isomerisation gasoline. The reformate, FCC gasoline and alkylate were identical to those of Example 1. Table 3 summarises the properties of the mixture with the proportions by volume of each constituent.

TABLE 3

| | Vol % | Paraf wt % | Aromat wt % | Benzene wt % | Olefins wt % | DMC5 wt % | RON | MON |
|---|---|---|---|---|---|---|---|---|
| Reformate | 38 | 25.1 | 73.0 | 3.2 | 0.8 | 1.3 | 98.7 | 88 |
| C5C6 hydro-isom | 12 | 84.0 | 0.1 | 0.1 | 0 | 0 | 83.1 | 81.7 |
| FCC | 30 | 24.7 | 34.6 | 1.2 | 33.1 | 1.2 | 94.8 | 83.4 |
| Alkylate | 10 | 99.9 | 0 | 0 | 0.1 | 3.3 | 93.4 | 91.9 |
| MTBE | 10 | 0 | 0 | 0 | 0 | 0 | 117 | 102 |
| Mixture | 100 | 38.1 | 38.2 | 1.6 | 10.2 | 1.2 | 97.4 | 86.2 |

By way of comparison, consider a premium grade type gasoline pool constituted by unchanged FCC gasoline, alkylate and MTBE bases, in the same proportions, with a smaller proportion of reformate. The C5–C8 cut was treated using the hydro-isomerisation process of the invention (variation 2.1*b,* FIG. 2.1B) which replaced the C5–C6 hydro-isomerisation unit described above. The composition of the isomerate was as that obtained after the pilot tests on the C5–C8 feed mentioned above. The separation section was upstream of the reaction section. The aromatic and naphthenic compounds initially contained in the feed were sent directly to the gasoline pool without isomerisation or saturation of the aromatic compounds.

TABLE 4

| | Vol % | Paraf wt % | Aromat wt % | Benzene wt % | Olefins wt % | DMC5 wt % | RON | MON |
|---|---|---|---|---|---|---|---|---|
| Reformate | 11.4 | 18.3 | 80.2 | 0.8 | 0.3 | 0 | 101.8 | 90.1 |
| C5C8 hydro-isom | 38.6 | 61.7 | 10.5 | 2.3 | 0 | 12.6 | 85.6 | 84.0 |
| FCC | 30 | 24.7 | 34.6 | 1.2 | 33.1 | 1.2 | 94.8 | 83.4 |
| Alkylate | 10 | 99.9 | 0 | 0 | 0.1 | 3.3 | 93.4 | 91.9 |
| MTBE | 10 | 0 | 0 | 0 | 0 | 0 | 117 | 102 |
| Mixture | 100 | 43.3 | 23.6 | 1.3 | 10.0 | 5.6 | 94.1 | 87.1 |

Now consider a mixture identical to the above, except for the hydro-isomerisation. In this example, the C5 cut (normal pentane, isopentane) contained in the straight run gasoline was sent directly to the gasoline pool without being isomerised. This could be achieved either by installing a depentaniser upstream of the hydro-isomerisation step, or by removing the C5 during atmospheric distillation or by removing the C5 from the head of a naphtha splitter. Only the C6–C8 cut was isomerised.

TABLE 5

| | Vol % | Paraf wt % | Aromat wt % | Benzene wt % | Olefins wt % | DMC5 wt % | RON | MON |
|---|---|---|---|---|---|---|---|---|
| Reformate | 11.4 | 18.3 | 80.20 | 0.8 | 0.3 | 0 | 101.8 | 90.1 |
| C5 cut | 6 | 100 | 0 | 0 | 0 | 0 | 80.9 | 79.5 |
| C6C8 hydro-isom | 32.6 | 47.9 | 14.3 | 3.2 | 0 | 14.9 | 83.6 | 82.0 |
| FCC | 30 | 24.7 | 34.6 | 1.2 | 33.1 | 1.2 | 94.8 | 83.4 |
| Alkylate | 10 | 99.9 | 0 | 0 | 0.1 | 3.3 | 93.4 | 91.9 |
| MTBE | 10 | 0 | 0 | 0 | 0 | 0 | 117 | 102 |
| Mixture | 100 | 41.1 | 24.2 | 1.5 | 10.0 | 5.6 | 93.2 | 86.2 |

In the cases illustrated in Tables 4 and 5, it can be seen that introducing C5–C8 or C6–C8 hydro-isomerisation gasoline resulted in a significant increase in MON over the composition of Table 3 which contained a gasoline from hydro-isomerisation of a C5–C6 cut. The quantity of benzene in the gasoline pool reduced by 0.3% while the total aromatic compound concentration was reduced by 14.6%, which is considerable. Sending the C5 cut directly to the gasoline pool without hydro-isomerisation was accompanied by a reduction of 0.9 in RON and MON with respect to the case where all of the C5–C7 cut was hydro-isomerised. As a result, installing a depentaniser upstream of the hydro-isomerisation step or extracting the C5 cut from the head of the naphtha splitter caused a substantial reduction in the size of the hydro-isomerisation section at the cost of a modest drop in octane number.

Further, it can be seen that in comparison with Table 1, introducing C5–C8 or C6–C8 hydro-isomerisation gasoline is accompanied by a substantial increase in the DMC5 content in the premium grade gasoline pool.

EXAMPLE 3

Hydro-isomerisation of a C5–C7 Cut Including a Light Reformate

1. Hydro-isomerisation of a light reformate cut at 85° C. and addition of a c5–C6 hydro-isomerisation gasoline (identical to that reported in Table 3, 18% of normal paraffins). In this case we consider a hydro-isomerisation process in accordance with variation 2.1*b,* i.e., separating the aromatic compounds upstream of the hydro-isomerisation section. These aromatic compounds were sent to the gasoline pool without being saturated.

Consider a gasoline pool constituted by FCC gasoline and alkylate already described in the preceding examples, also heavy reformate (initial point 80° C.; end point 220° C.) and light reformate+light gasoline hydro-isomerised using the process of the invention (the aromatic compounds being extracted upstream of the isomerisation section).

TABLE 6

| | Vol % | Paraf wt % | Aromat wt % | Benzene wt % | Olefins wt % | Oxgy wt % | RON | MON |
|---|---|---|---|---|---|---|---|---|
| Reformate 80–220° C. | 32 | 12.2 | 82.0 | 0 | 0.3 | 0 | 101.3 | 90.7 |
| Light reformate | 6 | 67.6 | 22.6 | 22.0 | 4.6 | 0 | 91.8 | 85.2 |
| C5C6 hydro-isom | 12 | 84.0 | 0.1 | 0.1 | 0 | 0 | 83.1 | 81.7 |
| FCC | 30 | 24.7 | 34.6 | 1.2 | 33.1 | 0 | 94.8 | 83.4 |
| Alkylate | 10 | 99.9 | 0 | 0 | 0.1 | 0 | 93.4 | 91.9 |

TABLE 6-continued

| | Vol % | Paraf wt % | Aromat wt % | Benzene wt % | Olefins wt % | Oxgy wt % | RON | MON |
|---|---|---|---|---|---|---|---|---|
| MTBE | 10 | 0 | 0 | 0 | 0 | 100 | 117 | 102 |
| Mixture | 100 | 38.1 | 38.0 | 1.7 | 10.3 | 10 | 98.0 | 86.7 |

Compared with the gasoline the composition of which was described in Table 3, which did not involve isomerisation of a light reformate, the aromatic compound content did not substantially vary but the RON increased by 0.6 and the MON increased by 0.5.

2. Hydro-isomerisation of a light reformate cut at 105° C. (half of the toluene from the reformate was in this cut) and addition of a C5–C6 hydro-isomerisation gasoline (identical to that of Table 3).

TABLE 7

| | Vol % | Paraf wt % | Aromat wt % | Benzene wt % | Olefins wt % | Oxgy wt % | RON | MON |
|---|---|---|---|---|---|---|---|---|
| Reformate 105–220° C. | 26 | 7.7 | 90.5 | 0 | 0.2 | 0 | 105.8 | 94.8 |
| Hydro-isom reformate IP 105° C. | 12 | 58.5 | 37.4 | 10.1 | 2.0 | 0 | 94.3 | 86.3 |
| C5C6 hydro-isom | 12 | 84.0 | 0.1 | 0.1 | 0 | 0 | 83.1 | 81.7 |
| FCC | 30 | 24.7 | 34.6 | 1.2 | 33.1 | 0 | 94.8 | 83.4 |
| Alkylate | 10 | 99.9 | 0 | 0 | 0.1 | 0 | 93.4 | 91.9 |
| MTBE | 10 | 0 | 0 | 0 | 0 | 100 | 117 | 102 |
| Mixture | 100 | 37.7 | 38.4 | 1.6 | 10.2 | 10 | 98.7 | 87.3 |

Compared with the gasoline described in Table 3, which did not involve isomerisation of a light reformate, the aromatic compound content did not substantially vary but the RON increased by 1.3 and the MON increased by 1.1. This gain, when compared with Table 6, is the consequence of isomerisation of the C7 paraffins of the raffinate.

3. Hydro-isomerisation of a light reformate cut at 105° C. then saturation and addition of a C5–C6 hydro-isomerisation gasoline (identical to that shown in Table 3).

TABLE 8

| | Vol % | Paraf wt % | Aromat wt % | Benzene wt % | Olefins wt % | Oxgy wt % | RON | MON |
|---|---|---|---|---|---|---|---|---|
| Reformate 105–220° C. | 26 | 7.7 | 90.5 | 0 | 0.2 | 0 | 105.8 | 94.8 |
| Hydro-isom reformate IP 105° C., saturation | 12 | 58.7 | 0 | 0 | 2.0 | 0 | 79.6 | 94.8 |
| C5C6 hydro-isom | 12 | 84.0 | 0.1 | 0.1 | 0 | 0 | 83.1 | 81.7 |
| FCC | 30 | 24.7 | 34.6 | 1.2 | 33.1 | 0 | 94.8 | 83.4 |
| Alkylate | 10 | 99.9 | 0 | 0 | 0.1 | 0 | 93.4 | 91.9 |
| MTBE | 10 | 0 | 0 | 0 | 0 | 100 | 117 | 102 |
| Mixture | 100 | 37.7 | 33.9 | 0.48 | 10.2 | 10 | 97.5 | 86.9 |

Compared with the preceding example, the aromatic compounds contained in the light reformate were saturated to naphthenic compounds. This could be accomplished by adding an aromatic compound hydrogenation section at the head of the hydro-isomerisation section. By comparison with table 7, the aromatic compound content reduced by 4.5% but the RON reduced by 1.2 and the MON by 0.4.

When compared with Table 3, i.e., with no hydro-isomerisation of the C5–C7 light reformate, the aromatic compounds reduced by 4.3% by weight, then the benzene content reduced to 1.1% by weight, the RON did not change (+0.1) and the MON increased by 0.7. Hydro-isomerisation of the light C5–C7 reformate with saturation of the aromatic compounds contained in the light reformate thus reduced the benzene content to below 0.8% by weight, which corresponds to the most severe of current regulations in the world (California), with no loss of RON, with a gain in MON, and a reduction in the total aromatic compounds content.

What is claimed is:

1. A process for producing a gasoline stock by hydroisomerization, said process comprising separating in at least one separation section at least one fraction of a C5 to C8 stream containing at least C-7 paraffins, straight-chain paraffins, mono-, di-, and tri-branched paraffins; and optionally naphthenes and aromatic compounds, into (1) a C5–C8 stream rich in di- and tri-branched paraffins and containing C7-di-branched paraffins and (2) at least one fraction of a C5–C8 effluent rich in straight chain and mono-branched paraffins; wherein said at least one fraction of said C5–C8 effluent comprises a first effluent stream rich in straight chain hydrocarbons and a second effluent stream rich in mono-branched paraffins; subjecting said first effluent stream to hydroisomerization in a first section; and combining the resultant hydroisomerizate from said first section with said second stream rich in mono-branched paraffins, subjecting the resultant combined stream to hydroisomerization in a second hydroisomerization section operated under conditions different from the first hydroisomerization section; and recycling said at least one fraction of the resulting C5–C8 hydromerizate from the second hydroisomerization section to said at least one separation section, and passing stream (1) to a gasoline pool to provide a minimum content of C7-di-branched paraffins of 2% by weight.

2. A process for producing a gasoline stock by hydroisomerization and separation of C5 to C8 stream containing at least C-7 paraffins, straight-chain paraffins, mono-, di-, and tri-branched paraffins; and optionally naphthenes and aromatic compounds, into (1) a C5–C8 stream rich in di- and tri-branched paraffins and containing C7-di-branched paraffins and (2) at least one fraction of a C5–C8 effluent containing straight chain and mono-branched paraffins; said process comprising first and second serially connected separation sections and first and second hydroisomerization sections, wherein said C5–C8 effluent comprises a first stream rich in straight chain paraffins withdrawn from said first separation section and a second stream rich in mono-branched paraffins withdrawn from said second separation section and wherein said first effluent stream is subjected to hydroisomerization in said first hydroisomerization section and the resultant first hydromerizate is recycled to the inlet of the first separation section, and the second effluent stream is subjected to hydroisomerization in said second hydroisomerization section operated under conditions different from the first hydroisomerization section and the resultant second hydroisomerization is recycled to the inlet of the second separation section downstream of said first separation section, and passing stream (1) to a gasoline pool to provide a minimum content of C7-di-branched paraffins of 2% by weight.

3. A process for producing a gasoline stock by hydroisomerization and separation of C5 to C8 stream containing at least C-7 paraffins, straight-chain paraffins, mono-, di-, and tri-branched paraffins; and optionally naphthenes and aromatic compounds, into (1) a C5–C8 stream rich in di- and tri-branched paraffins and containing C7-di-branched paraffins and (2) at least one fraction of a C5–C8 effluent containing straight chain and mono-branched paraffins; said process comprising first and second hydroisomerization sections, and wherein said first effluent stream is subjected to hydroisomerization in said first hydroisomerization section, and said second effluent stream is subjected to hydroisomerization in said second hydroisomerization section operated under conditions different from the first hydroisomerization section, and hydromerizates from both hydroisomerization sections are separately recycled to said at least one separation section, and recycling said at least one fraction of the resulting C5–C8 hydromerizate from the second hydroisomerization section to said at least one separation section, and passing stream (1) to a gasoline pool to provide a minimum content of C7-di-branched paraffins of 2% by weight.

* * * * *